US006784143B2

(12) United States Patent
Locke et al.

(10) Patent No.: US 6,784,143 B2
(45) Date of Patent: Aug. 31, 2004

(54) LUBRICATING OIL COMPOSITION

(75) Inventors: Christopher J. Locke, Wantage (GB); Mark G. Stevens, Metuchen, NJ (US); Peter Wrench, Wantage (GB); Stephen Arrowsmith, Didcot (GB); Rebecca C. Castle, Kidlington (GB); Jane R. Galsworthy, Oxford (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/142,513

(22) Filed: May 9, 2002

(65) Prior Publication Data

US 2003/0096716 A1 May 22, 2003

(30) Foreign Application Priority Data

May 11, 2001 (EP) ..... 01201752
Nov. 30, 2001 (GB) ..... 0128734

(51) Int. Cl.[7] ..... C10M 129/54
(52) U.S. Cl. ..... 508/460; 508/518
(58) Field of Search ..... 508/518, 460

(56) References Cited

U.S. PATENT DOCUMENTS 3,625,893 A * 12/1971 Brook et al. ..... 508/378
5,422,022 A * 6/1995 Chamberlin, III ..... 508/390
5,558,802 A * 9/1996 Dowling ..... 508/391
5,804,537 A * 9/1998 Boffa et al. ..... 508/398
6,103,672 A 8/2000 Dunn et al. ..... 508/185
6,331,510 B1 * 12/2001 Curtis et al. ..... 508/578
6,348,438 B1 * 2/2002 Le Coent et al. ..... 508/332
6,423,670 B2 * 7/2002 Locke et al. ..... 508/192
6,569,818 B2 * 5/2003 Nakazato et al. ..... 508/185
6,569,819 B2 * 5/2003 Yagishita et al. ..... 508/291
6,588,393 B2 * 7/2003 Chamberlin, III et al. ..... 123/196 R

FOREIGN PATENT DOCUMENTS

EP 0 855 437 A1 7/1998 ..... C10M/135/18
WO WO94/28095 12/1994 ..... C10M/135/18
WO WO96/37582 11/1996 ..... C10M/135/18

* cited by examiner

*Primary Examiner*—Ellen M. McAvoy

(57) ABSTRACT

The use, in a minor amount, of a detergent composition comprising one or more metal detergents which comprises metal salts of organic acids, wherein the detergent composition comprises more than 50 mole %, based on the moles of the metal salts of organic acids in the detergent composition, of:

(I) a metal salt of an aromatic carboxylic acid, or (II) a metal salt of a phenol, or (III) both a metal salt of an aromatic carboxylic acid and a metal salt of a phenol, in a lubricating oil composition for improving the oxidation resistance of the lubricating oil composition, wherein the amount of phosphorus and sulfur in the oil composition is less than 0.09 mass % and at most 0.5 mass % respectively, based on the mass of the oil composition. It has also been found that a detergent composition comprising more than 50 mole % of a metal salt of an aromatic carboxylic acid improves the reduction in wear in an engine.

4 Claims, No Drawings

LUBRICATING OIL COMPOSITION

The present invention concerns the use of a defined detergent composition in a lubricating oil composition for reducing wear in an engine. It also relates to a lubricating oil composition for use in an internal combustion engine, preferably a heavy duty diesel engine, and a method for the preparation thereof.

The need for less toxic emissions from exhaust gases is becoming more demanding, mainly because of environmental problems such as the emission of pollutants such as hydrocarbons, carbon monoxide and nitrogen oxides. Catalytic converters in the exhaust systems have been used to reduce the emission of pollutants. Such converters generally use a combination of catalytic metals, such as platinum or variations thereof and metal oxides, and are installed in the exhaust streams, e.g. the exhaust pipes of automobiles to convert the toxic gases to non-toxic gases. Phosphorus components, such as the decomposition products of the zinc dithiophosphate, are believed to poison the catalyst in these converters. Also it is likely that sulfur components poison the catalysts, for example those used in reduction of nitrogen oxides.

Thus, there is automotive industry pressure towards reducing phosphorus and sulfur contents in lubricating oil compositions.

This can be achieved by reducing the amount of phosphorus and sulfur components in the oil composition, for example, by reducing the amount of zinc dithiophosphate. However, this presents problems, for example, lowering the anti-wear properties and anti-oxidant properties of the oil composition.

Generally, the art describes phosphorus-, sulfur- and molybdenum-containing compounds as anti-wear and/or anti-oxidant additives.

It has surprisingly been found that a particular detergent composition provides anti-wear benefit to lubricating oil compositions having a low phosphorus content, and optionally a low sulfur content, preferably to lubricating oil compositions which have both low phosphorus and low sulfur contents.

Therefore, in a first aspect, the present invention provides the use, in a minor amount, of a detergent composition comprising one or more metal detergents which comprises metal salts of organic acids, wherein the detergent composition comprises more than 50 mole % of a metal salt of an aromatic carboxylic acid, based on the moles of the metal salts of organic acids in the detergent composition, in a lubricating oil composition for reducing wear in an engine, wherein the amount of phosphorus and sulfur in the oil composition is less than 0.09 mass % and at most 0.5 mass % respectively, based on the mass of the oil composition.

It has also been found that another particular detergent composition provides oxidation resistance to lubricating oil compositions having a low phosphorus content, and optionally a low sulfur content, preferably to lubricating oil compositions which have both low phosphorus and low sulfur contents Accordingly, in a second aspect, the present invention provides the use, in a minor amount, of a detergent composition comprising one or more metal detergents which comprises metal salts of organic acids, wherein the detergent composition comprises more than 50 mole %, based on the moles of the metal salts of organic acids in the detergent composition, of:

(I) a metal salt of an aromatic carboxylic acid, or (II) a metal salt of a phenol, or (III) both a metal salt of an aromatic carboxylic acid and a metal salt of a phenol, in a lubricating oil composition for improving the oxidation resistance or control of the lubricating oil composition, wherein the amount of phosphorus and sulfur in the oil composition is less than 0.09 mass % and at most 0.5 mass % respectively, based on the mass of the oil composition.

In a third aspect, the present invention provides an SAE 5WX or SAE 0WX lubricating oil composition comprising:

(A) an oil of lubricating viscosity, in a major amount, and added thereto:

(B) a detergent composition comprising one or more metal detergents which comprises metal salts of organic acids, in a minor amount, wherein the detergent composition comprises more than 50 mole %, based on the moles of the metal salts of organic acids in the detergent composition, of:

(B1) a metal salt of an aromatic carboxylic acid, or (B2) a metal salt of a phenol, or (B3) both a metal salt of an aromatic carboxylic acid and a metal salt of a phenol, and (C) co-additives comprising (C1) a dispersant additive and/or a dispersant viscosity index improver additive, (C2) an antioxidant additive and (C3) an antiwear additive, in respective minor amounts;

wherein the amount of phosphorus derived from (B) or (C) or both (B) and (C) is less than 0.09 mass %; and the amount of sulfur derived from (B) or (C) or both (B) and (C) is at most 0.5 mass %; each based on the mass of the oil composition; and X represents any one of 20, 30, 40 and 50. The terms 5WX and 0WX, where X is any one of 20, 30, 40 and 50, is derived from the SAE J300 classification.

In a fourth aspect, the present invention provides a lubricating oil composition comprising:

(A) an oil of lubricating viscosity, in a major amount, and added thereto:

(B) a detergent composition comprising one or more metal detergents which comprises metal salts of organic acids, in a minor amount, wherein the detergent composition comprises more than 50 mole %, based on the moles of the metal salts of organic acids in the detergent composition, of:

(B1) a metal salt of an aromatic carboxylic acid, or (B2) a metal salt of a phenol, or (B3) both a metal salt of an aromatic carboxylic acid and a metal salt of a phenol, and (C) co-additives comprising (C1) a dispersant viscosity index improver additive, (C2) an antioxidant additive and (C3) an antiwear additive, in respective minor amounts;

wherein the amount of phosphorus derived from (B) or (C) or both (B) and (C) is less than 0.09 mass %; and the amount of sulfur derived from (B) or (C) or both (B) and (C) is at most 0.5 mass %; each based on the mass of the oil composition.

In a fifth aspect, the present invention provides a lubricating oil composition comprising:

(A) an oil of lubricating viscosity, in a major amount, and added thereto:

(B) a detergent composition comprising at least one detergent that contains metal salts of more than one type of organic acid, in a minor amount, wherein the detergent composition comprises more than 50 mole %, based on the moles of the metal salts of organic acids in the detergent composition, of:

(B1) a metal salt of an aromatic carboxylic acid, or (B2) a metal salt of a phenol, or (B3) both a metal salt of an aromatic carboxylic acid and a metal salt of a phenol, and (C) co-additives comprising (C1) a dispersant and/or a dispersant viscosity index improver additive, (C2) an antioxidant additive and (C3) an antiwear additive, in respective minor amounts;

wherein the amount of phosphorus derived from (B) or (C) or both (B) and (C) is less than 0.09 mass %; and the amount of sulfur derived from (B) or (C) or both (B) and (C) is at most 0.5 mass %; each based on the mass of the oil composition.

In a sixth aspect, the present invention provides a lubricating oil composition comprising:

(A) an oil of lubricating viscosity comprising a synthetic basestock, in a major amount, and added thereto:

(B) a detergent composition comprising one or more metal detergents which comprises metal salts of organic acids, in a minor amount, wherein the detergent composition comprises more than 50 mole %, based on the moles of the metal salts of organic acids in the detergent composition, of:

(B1) a metal salt of an aromatic carboxylic acid, or (B2) a metal salt of a phenol, or (B3) both a metal salt of an aromatic carboxylic acid and a metal salt of a phenol, and (C) co-additives comprising (C1) a dispersant and/or a dispersant viscosity index improver additive, (C2) an antioxidant additive and (C3) an antiwear additive, in respective minor amounts;

wherein the amount of phosphorus derived from (B) or (C) or both (B) and (C) is less than 0.09 mass %, and the amount of sulfur derived from (B) or (C) or both (B) and (C) is at most 0.5 mass %, each based on the mass of the oil composition.

In a seventh aspect, the present invention provides an additive composition, for preparing a lubricating oil composition according to any one of the third to sixth aspect, having less than 0.6 mass % of phosphorus and, preferably, at most 2.5 mass % of sulfur, based on the mass of the additive composition, said additive composition comprising:

(a) a diluent or carrier fluid;

(b) a detergent composition as defined in any one of the third to sixth aspect;

(c) one or more a phosphorus-containing and/or sulfur-containing compounds;

(d) one or more anti-oxidant additives, and (e) one or more co-additives, different from (b), (c) and (d), such as a dispersant additive.

In an eighth aspect, the present invention provides a method of lubricating an internal combustion engine, preferably a heavy duty diesel engine, comprising supplying to the engine the lubricating oil composition according to any one of the third to sixth aspect.

In a ninth aspect, the present invention provides a method of preparing a lubricating oil composition of any one of the third to sixth aspect comprising admixing components (A), (B) and (C) as defined in the corresponding third to sixth aspect or admixing an additive composition of the seventh aspect and an oil of lubricating viscosity as defined in the corresponding third to sixth aspect.

Further, the present invention provides the use of an oil composition according to any one of the third to sixth aspect for reducing wear in an engine.

The features of the present invention will now be discussed in more detail.

Lubricating Oil Composition

Preferably the amount of phosphorus, in respect of each aspect, in the lubricating oil composition, independently of the amount of sulfur, is less than 0.08, less than 0.07 or less than 0.06, more preferably at most 0.05, at most 0.04 or at most 0.03, such as in the range from 0.001 to 0.03, for example at most 0.02 or at most 0.01, mass %, based on the mass of the oil composition. In a preferred embodiment of each aspect, the phosphorus content is zero in the lubricating oil composition.

The amount of sulfur, in respect of each aspect, in the lubricating oil composition, independently of the amount of phosphorus, is preferably at most 0.45, or at most 0.4, or at most 0.35, or at most 0.3, or at most 0.25, especially at most 0.2 or at most 0.15, such as in the range from 0.001 to 0.1 or 0.005 to 0.05, mass %, based on the mass of the oil composition. In a preferred embodiment of each aspect, the sulfur content is zero in the lubricating oil composition.

In an embodiment of each aspect of the invention, the amount of phosphorus and sulfur is derived from an antiwear additive, such as a zinc dithiophosphate.

In a preferred embodiment of each aspect of the present invention, independently of the other embodiments, the amount of chlorine in the lubricating oil composition is at most 100, preferably at most 50, such as at most 30, more preferably at most 20, especially at most 10, for example from 0 to 5, ppm, based on the mass of the oil composition. It is advantageous to reduce the amount of chlorine so as to decrease the production of dioxins.

Independently of each other, the amount of phosphorus and sulfur in the lubricating oil composition is preferably derived from both (B) and (C); more preferably the amount is derived from (A), (B) and (C).

In an embodiment of appropriate aspects of the invention, independently of the other embodiments, the lubricating oil composition is in the form of an SAE 5WX or SAE 0WX lubricating oil composition, wherein X represents any one of 20, 30, 40 and 50. Preferably, X represents 20 or 30.

In an embodiment of each aspect, the amount of nitrogen, independently of the other embodiments, is preferably at least 0.01 or at least 0.02, more preferably at least 0.05, such as at least 0.055, advantageously at least 0.06, especially at least 0.065, such as at least 0.1, mass %, based on the mass of the oil composition. The amount of nitrogen is preferably at most 0.3, such as at most 0.25, or at most 0.2, or at most 0.15, mass %, based on the mass of the oil composition.

In an embodiment of each aspect of the invention, the amount of nitrogen is derived from a dispersant additive, such as a polyisobutenyl succinimide.

In another embodiment of appropriate aspects of the invention, independently of the other embodiments, the amount of anti-oxidant additive is at least 0.1, preferably at least 0.5, especially at least 1.0, most preferably at most 5.0, mass %, based on the mass of the oil composition.

In a preferred embodiment of each aspect of the invention, the lubricating oil composition does not comprise one or more of a co-additive (C) selected from a phosphorus-containing compound, a sulfur-containing compound and a molybdenum-containing compound. For example, the lubricating oil composition does not comprise a phosphorus-containing and/or a molybdenum-containing compound, such as a zinc dithiodiphosphate and/or a molybdenum dithiocarbamate.

The lubricating oil compositions of the present invention are preferably crankcase lubricating oil compositions suitable for lubricating an internal combustion engine, preferably a passenger car engine or a heavy duty diesel engine.

Examples of passenger car engines are light duty diesel engines and gasoline engines.

The heavy duty trucking market has come to adopt the diesel engine as its preferred power source due to both its excellent longevity and its economy of operation. Specialized lubricants have been developed to meet the more stringent performance requirements of heavy duty diesel engines.

Several engine tests are required to demonstrate satisfactory heavy duty performance, including the Cummins M11 test to evaluate soot-related valve train wear, filter plugging and sludge.

The American Petroleum Institute (API), Association des Constructeur Europeén d'Automobile (ACEA) and Japanese Standards Organisation (JASO) specify the performance level required for lubricating oil compositions. Also there are performance specifications known as Global, which contain tests and performance levels from ACEA, API and JASO specifications.

Thus, a heavy duty lubricating oil composition of the present invention preferably satisfies at least the performance requirements of heavy duty diesel engine lubricants, such as at least the API CG-4; preferably at least the API CH-4; especially at least the API CI-4. In another embodiment, the lubricating oil composition of the invention, independently of meeting the API performance requirements, preferably satisfies at least the ACEA E2-96; more preferably at least the ACEA E3-96; especially at least ACEA E4-99; advantageously at least the ACEA E5-99. In a further embodiment, the lubricating oil composition of the invention, independently of meeting the API and ACEA performance requirements, preferably satisfies the JASO DH-1 or Global DHD-1.

In respect of a passenger car engine, such as a gasoline or diesel engine, lubricating oil composition, the lubricating oil composition preferably satisfies at least the performance requirements of API SH; more preferably at least the API SJ; especially at least the API SL. In another embodiment, the lubricating oil composition of the invention, independently of meeting the API performance requirements, preferably satisfies at least the ACEA A2-96 (issue 2), more preferably at least the ACEA A3-98, especially at least the ACEA A1-98, for gasoline engines; and at least ACEA B2-98, more preferably at least the ACEA B1-98, such as at least the ACEA B3-98, especially at least the ACEA B4-98, for light duty diesel engines.

As mentioned above, the defined metal detergent composition according to the first aspect has been found to exhibit anti-wear properties in lubricating oil compositions having a low phosphorus content, and optionally a low sulfur content. The amount of phosphorus or sulfur in such an oil composition corresponds to the amount of phosphorus and sulfur disclosed above. The anti-wear benefit is expected in the valve trains, journal bearing, and piston rings or liner; especially in the valve trains.

Accordingly, in a further aspect, the present invention provides a lubricating oil composition according to the third aspect, but where the detergent composition comprises more than 50 mole %, based on the moles of the metal salts of organic acids in the detergent composition, of (B1) a metal salt of an aromatic carboxylic acid, and (C1) is a dispersant additive.

In a preferred embodiment of each aspect of the present invention, the oil composition gives less than 2, preferably less than 1.5, especially less than 1, advantageously less than 0.9 or 0.8 or 0.7 or 0.6, such as in the range from 0 or 0.1 or 0.2 or 0.3 or 0.4 to 0.5, mass % of sulfated ash, according to method ASTM D874.

Heavy Duty Diesel Engines

Heavy duty diesel engines according to the present invention are preferably used in land-based vehicles, more preferably large road vehicles, such as large trucks. The road vehicles typically have a weight greater than 12 tonnes. The engines used in such vehicles tend to have a total displacement of at least 6.5, preferably at least 8, more preferably at least 10, such as at least 15, liters; engines having a total displacement of 12 to 20 liters are preferred. Generally, engines having a total displacement greater than 24 liters are not considered land-based vehicles. The engines according to the present invention also have a displacement per cylinder of at least 1.0 or at least 1.5, such as at least 1.75, preferably at least 2, liters per cylinder. Generally, heavy duty diesel engines in road vehicles have a displacement per cylinder of at most 3.5, such as at most 3.0; preferably at most 2.5, liters per cylinder.

As used herein, the terms 'total displacement' and 'displacement per cylinder' are known to those skilled in the art of internal combustion engines (see "Diesel Engine Reference Book", edited by B. Challen and R. Baranescu, second edition, 1999, published by SAE International). Briefly, the term 'displacement' corresponds to the volume of the cylinder in the engine as determined by the piston movement and consequently the 'total displacement' is the total volume dependent on the number of cylinders; and the term 'displacement per cylinder' is the ratio of the total displacement to the number of cylinders in the engine.

Thus, in an aspect, the present invention provides a combination of a heavy duty diesel engine, preferably in a land-based vehicle, which engine has a total displacement of at least 6.5 liters and a displacement per cylinder of at least 1.0 liter per cylinder and a lubricating oil composition as defined in any one of the third to sixth aspect.

Oil of Lubricating Viscosity (A)

The lubricating oil can be a synthetic or mineral oil of lubricating viscosity selected from the group consisting of Group I, II, III, IV or V basestocks and mixtures of thereof.

Basestocks may be made using a variety of different processes including but not limited to distillation, solvent refining, hydrogen processing, oligomerization, esterification, and rerefining.

American Petroleum Institute (API) 1509 "Engine Oil Licensing and Certification System" Fourteenth Edition, December 1996 states that all basestocks are divided into five general categories:

Group I basestocks contain less than 90% saturates and/or greater than 0.03% sulfur and have a viscosity index greater than or equal to 80 and less than 120;

Group II basestocks contain greater than or equal to 90% saturates and less than or equal to 0.03% sulfur and have a viscosity index greater than or equal to 80 and less than 120;

Group III basestocks contain greater than or equal to 90% saturates and less than or equal or 0.03% sulfur and have a viscosity index greater than or equal to 120;

Group IV basestocks are polyalphaolefins (PAO); and

Group V basestocks contain all other basestocks not included in Group I, II, III or IV.

Group IV basestocks, i.e. polyalphaolefins (PAO), include hydrogenated oligomers of an alpha-olefin, the most important methods of oligomerization being free radical processes, Ziegler catalysis, cationic, and Friedel-Crafts catalysis.

Group V basestocks in the form of esters are preferred and also tend to be commercially available. Examples include polyol esters such as pentaerythritol esters, trimethylolpropane esters and neopentylglycol esters; diesters; $C_{36}$ dimer acid esters; trimellitate esters, i.e., 1,2,4-benzene tricarboxylates; and phthalate esters, i.e., 1,2-benzene dicarboxylates. The acids from which the esters are made are preferably monocarboxylic acids of the formula $RCO_2H$ where R represents a branched, linear or mixed alkyl group. Such acids may, for example, contain 6 to 18 carbon atoms.

Preferably the lubricating oil is selected from any one of Group I to V basestocks, provided the selected basestock contains at most 0.5, such as at most 0.1 or at most 0.05, mass % of sulfur.

Especially preferred is Group II, III, IV or V basestock or any two or more mixtures thereof, or mixtures of a Group IV basestock with 5 to 95, preferably 10 to 90, such as 20 to 85, mass %, of Group I, II, III or V basestock, provided the sulfur content is at most 0.5, such as at most 0.1 or at most 0.05, mass %.

A Group IV basestock and a Group V basestock in the form of an ester are considered synthetic basestocks.

Accordingly, in a preferred embodiment of appropriate aspects of the present invention, independently of the other embodiments, the oil of lubricating viscosity comprises a synthetic basestock.

Therefore, the oil of lubricating viscosity comprises at least one basestock selected from a Group IV basestock and a Group V basestock in the form of an ester. Preferably, the oil of lubricating viscosity consists essentially of:

(a) a Group IV basestock and a Group III basestock and/or a Group II basestock; or (b) a Group V basestock in the form of an ester and a Group III basestock and/or a Group II basestock; or (c) a Group IV basestock and a Group V basestock in the form of an ester and optionally a Group III basestock and/or a Group II basestock.

The test methods used in defining the above groups are ASTM D2007 for saturates; ASTM D2270 for viscosity index; and one of ASTM D2622, 4294, 4927 and 3120 for sulfur.

Detergent Composition (B)

A detergent is an additive that reduces formation of piston deposits, for example high-temperature varnish and lacquer deposits, in engines; it has acid-neutralising properties and is capable of keeping finely divided solids in suspension. It is based on metal "soaps", that is metal salts of organic acids, also known as surfactants herein.

A detergent comprises a polar head, i.e. the metal salt of the organic acid, with a long hydrophobic tail for oil solubility. Therefore, the organic acids typically have one or more functional groups, such as OH or COOH or $SO_3H$; and a hydrocarbyl substituent.

Examples of organic acids include sulfonic acids, phenols and sulfurised derivatives thereof, and carboxylic acids including aromatic carboxylic acids.

It has been found, according to an aspect of the present invention, that a metal detergent composition comprising more than 50 mole % of a metal salt of an aromatic carboxylic acid, based on the moles of the metal salts of organic acids in the detergent composition, provides a wear benefit, such as the ability to minimise the wear in an engine, to lubricating oil compositions having a low phosphorus content, and optionally a low sulfur content, preferably to lubricating oil compositions having low phosphorus and low sulfur contents.

Preferably the proportion of the metal salt of an aromatic carboxylic acid is at least 60 or at least 70, more preferably at least 80 or at least 90, mole %, based on the moles of the metal salts of organic acids in the detergent composition.

In a most preferred embodiment, the detergent composition comprises 100 mole % of a metal salt of an aromatic carboxylic acid, based on the moles of the metal salts of organic acids in the detergent composition, that is the detergent composition comprises only aromatic carboxylic acids as the organic acids.

It has also been found, according to another aspect of the present invention, that a metal detergent composition comprising more than 50 mole %, based on the moles of the metal salts of organic acids in the detergent composition, of:

(I) a metal salt of an aromatic carboxylic acid, or (II) a metal salt of a phenol, or (III) both a metal salt of an aromatic carboxylic acid and a metal salt of a phenol, provides oxidation resistance to a lubricating oil composition having a low phosphorus content, and optionally a low sulfur content, preferably to lubricating oil compositions having low phosphorus and low sulfur contents.

The proportion of the metal salt selected from (I), (II) and (III) is preferably at least 60 or at least 70, more preferably at least 80 or at least 90, mole %, based on the moles of the metal salts of organic acids in the detergent composition.

In a most preferred embodiment, the detergent composition comprises 100 mole % of a metal salt of both a metal salt of an aromatic carboxylic acid and a metal salt of a phenol, based on the moles of the metal salts of organic acids in the detergent composition, that is the detergent composition comprises only aromatic carboxylic acids and phenols as the organic acids.

For better oxidation resistance of a lubricating oil composition, it is preferred that where both a metal salt of an aromatic carboxylic acid and a metal salt of a phenol are present in the detergent composition, more of the metal salt of a phenol than the metal salt of an aromatic carboxylic acid is present, based on moles. Advantageously, it has been found that a detergent composition having only metal salts of phenols provides better oxidation resistance to a lubricating oil composition compared with detergent compositions having metal salts of aromatic carboxylic acids and/or metal salts of other organic acids, for example, sulfonic acids.

For better anti-wear properties of a lubricating oil composition, it is preferred that a detergent composition contains a metal salt of an aromatic carboxylic acid in an amount of more than 50 mole %, based on the moles of the organic acids in the detergent composition.

The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety.

The aromatic carboxylic acid may contain one or more aromatic moieties, such as one or more benzene rings, either fused or connected via alkylene bridges.

The carboxylic moiety may be attached directly or indirectly to the aromatic moiety. Preferably the carboxylic acid group is attached directly to a carbon atom on the aromatic moiety, such as a carbon atom on the benzene ring.

More preferably, the aromatic moiety also contains a second functional group, such as a hydroxy group or a sulfonate group, which can be attached directly or indirectly to a carbon atom on the aromatic moiety.

Preferred examples of an aromatic carboxylic acids are salicylic acids and sulfurised derivatives thereof, such as hydrocarbyl substituted salicylic acid and derivatives thereof.

Processes for sulfurizing, for example a hydrocarbyl-substituted salicylic acid, are known to those skilled in the art.

Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents in oil-soluble salicylic acids are alkyl substituents. In alkyl—substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil-solubility.

Phenols may be non-sulfurized or, preferably, sulfurized. Further, the term "phenol" as used herein includes phenols containing more than one hydroxyl group (for example, alkyl catechols) or fused aromatic rings (for example, alkyl naphthols) and phenols which have been modified by chemical reaction, for example, alkylene-bridged phenols and Mannich base-condensed phenols; and saligenin-type phenols (produced by the reaction of a phenol and an aldehyde under basic conditions).

Preferred phenols are of the formula

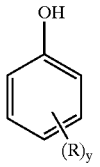

where R represents a hydrocarbyl group and y represents 1 to 4. Where y is greater than 1, the hydrocarbyl groups may be the same or different.

The phenols are frequently used in sulfurized form. Details of sulfurization processes are known to those skilled in the art, for example, see U.S. Pat. Nos. 4,228,022 and 4,309,293.

In the above formula, hydrocarbyl groups represented by R are advantageously alkyl groups, which advantageously contain 5 to 100, preferably 5 to 40, especially 9 to 12, carbon atoms, the average number of carbon atoms in all of the R groups being at least about 9 in order to ensure adequate solubility in oil. Preferred alkyl groups are nonyl (e.g. tripropylene) groups or dodecyl (e.g. tetrapropylene) groups.

As indicated above, the term "phenol" as used herein includes phenols which have been modified by chemical reaction with, for example, an aldehyde, and Mannich base-condensed phenols.

Aldehydes with which phenols may be modified include, for example, formaldehyde, propionaldehyde and butyraldehyde. The preferred aldehyde is formaldehyde. Aldehyde-modified phenols suitable for use in accordance with the present invention are described in, for example, U.S. Pat. No. 5 259 967.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above. Examples of such substituents are methoxy groups and halogen atoms.

A preferred phenol is a sulfurised derivative thereof.

The detergent composition can comprise, in minor amounts, metal salts of organic acids other than aromatic carboxylic acids and phenols, such as sulfonic acids and carboxylic acids.

Sulfonic acids are typically obtained by sulfonation of hydrocarbyl-substituted, especially alkyl-substituted, aromatic hydrocarbons, for example, those obtained from the fractionation of petroleum by distillation and/or extraction, or by the alkylation of aromatic hydrocarbons. The alkylaryl sulfonic acids usually contain from about 22 to about 100 or more carbon atoms. The sulfonic acids may be substituted by more than one alkyl group on the aromatic moiety, for example they may be dialkylaryl sulfonic acids. Preferably the sulfonic acid has a number average molecular weight of 350 or greater, more preferably 400 or greater, especially 500 or greater, such as 600 or greater. Number average molecular weight may be determined by ASTM D3712.

Another type of sulfonic acid which may be used in accordance with the invention comprises alkyl phenol sulfonic acids. Such sulfonic acids can be sulfurized.

Carboxylic acids include mono- and dicarboxylic acids. Preferred monocarboxylic acids are those containing 8 to 30, especially 8 to 24, carbon atoms. (Where this specification indicates the number of carbon atoms in a carboxylic acid, the carbon atom(s) in the carboxylic group(s) is/are included in that number). Examples of monocarboxylic acids are iso-octanoic acid, stearic acid, oleic acid, palmitic acid and behenic acid. Iso-octanoic acid may, if desired, be used in the form of the mixture of C8 acid isomers sold by Exxon Chemical under the trade name "Cekanoic". Other suitable acids are those with tertiary substitution at the $\alpha$-carbon atom and dicarboxylic acids with 2 or more carbon atoms separating the carboxylic groups.

Further, dicarboxylic acids with more than 35 carbon atoms, for example, 36 to 100 carbon atoms, are also suitable. Unsaturated carboxylic acids can be sulfurized.

The metal detergent may be neutral or overbased, such terms are known in the art.

The detergents can have a Total Base Number (TBN) in the range of 15 or 60 to 600, preferably 100 to 450, more preferably 160 to 400. TBN is measured according to ASTM D-2896.

The detergents of the present invention may be salts of one type of organic acid or salts of more than one type of organic acids, for example hybrid complex detergents.

In an embodiment, the detergent comprises metal salts of one type of organic acid. A hybrid complex detergent is a detergent in which the basic material within the detergent is stabilised by metal salts of more than one type of organic acid. It will be appreciated by one skilled in the art that a single type of organic acid may contain a mixture of organic acids of the same type. For example, a sulfonic acid may contain a mixture of sulfonic acids of varying molecular weights. Such an organic acid composition is considered as one type. Thus, complex detergents are distinguished from mixtures of two or more separate, optionally overbased, detergents, an example of such a mixture being one of an overbased calcium salicylate detergent with an overbased calcium phenate detergent.

The art describes examples of overbased complex detergents. For example, International Patent Application Publication Nos. 9746643/4/5/6 and 7, which are incorporated herein in respect of the description and definition of the hybrid complex detergents, describe hybrid complexes made by neutralising a mixture of more than one acidic organic compound with a basic metal compound, and then overbasing the mixture. Individual basic micelles of the detergent are thus stabilised by a plurality of organic acid types. Examples of hybrid complex detergents include calcium phenate-salicylate-sulfonate detergent, calcium phenate-sulfonate detergent and calcium phenate-salicylate detergent.

EP-A-0 750 659 describes a calcium salicylate phenate complex made by carboxylating a calcium phenate and then sulfurising and overbasing the mixture of calcium salicylate and calcium phenate. Such complexes may be referred to as "phenalates"

Preferred complex detergents are salicylate-based detergents, for example, a calcium phenate-salicylate detergent and "phenalates".

In a further embodiment of appropriate aspects of the present invention, independently of the other embodiments, a preferred detergent contains metal salts of more than one type of organic acid (i.e. a hybrid complex detergent). Therefore, the detergent can contain, for example, a metal, preferably calcium, salt of a salicylic acid and/or a metal, preferably calcium, salt of a phenol, and a metal salt of another of organic acid, for example, a sulfonic acid.

In the instance where more than one type of organic acids is present in a single detergent (i.e. a hybrid complex detergent), the proportion of any one type of organic acid to another is not critical, provided the detergent composition comprises the defined proportion of the appropriate metal salt(s) as defined in the appropriate aspect of the present invention.

For the avoidance of doubt, the detergent composition may also comprise an ashless detergent, i.e. a non-metal containing detergent.

Preferably the detergent composition comprises at least one overbased metal detergent, irrespective of whether the detergent contains metal salts of one type of organic acid or metal salts of more than one type of organic acid.

A preferred overbased metal detergent comprises a metal salt of an aromatic carboxylic acid, preferably a metal salt of a salicylic acid; or a metal salt of a phenol, preferably a metal salt of a sulfurised alkyl phenol; or both a metal salt of an aromatic carboxylic acid and a metal salt of a phenol.

Group 1 and Group 2 metals are preferred as metals in the detergents, more preferably calcium and magnesium, especially calcium.

Detergent compositions comprising, preferably consisting essentially of, at least one calcium salicylate-based detergent, preferably at least one overbased calcium salicylate-based detergent, have been found to particularly effective in providing anti-wear benefits, provided the proportion of the metal salt of an aromatic carboxylic acid, in this instance the metal salt of the salicylic acid, is satisfied. Therefore, detergent compositions comprising only calcium salicylate-based detergents, whether neutral or overbased, would be advantageous. Preferably, the calcium salicylate-based detergent may contain one or more metal, preferably calcium, salts of organic acids other than salicylic acid, such as sulfonic acid and/or phenol.

Detergent compositions comprising, preferably consisting essentially of, at least one calcium phenate-based detergent, preferably at least one overbased calcium phenate-based detergent, have been found to particularly effective in providing oxidation resistance, provided the proportion of the metal salt of a phenol is satisfied. Therefore, detergent compositions comprising only calcium phenate-based detergents, whether neutral or overbased, would be advantageous. Preferably, the calcium phenate-based detergent may contain one or more metal, preferably calcium, salts of organic acids other than phenol, such as salicylic acid and/or sulfonic acid.

Preferably, the detergent composition, in respect of each aspect, is present in the oil composition in an amount, based on surfactant content, of at least 5, preferably at least 10, such as at least 20 or at least 30, more preferably at least 50, most especially at most 75, millimoles of surfactant per kilogram of the oil composition (mmol/kg). In an embodiment, the amount of detergent composition, based on surfactant content, in the oil composition is 10 to 15 mmol/kg.

Suitable methods for measuring the total metal content are well known in the art and include X-ray fluorescence and atomic absorption spectrometry.

Suitable methods for determining the amount of metal associated with the organic acids include potentiometric acid titration of the metal salt to determine the relative proportions of the different basic constituents (for example, metal carbonate and metal organic acid salts); hydrolysis of a known amount of metal salt and then the potentiometric base titration of the organic acids to determine the equivalent moles of organic acids; and determination of the non-organic acid anions, such as carbonate, by measuring the $CO_2$ content.

In the case of a metal sulfonate, ASTM D3712 may be used to determine the metal associated with the sulfonate.

In the instance where a composition comprises a detergent and one or more co-additives, then the detergent may be separated from the co-additives, for example, by using dialysis techniques and then the detergent may be analysed as described above to determine the metal ratio. Background information on suitable dialysis techniques is given by Amos, R. and Albaugh, E. W. in "Chromatography in Petroleum Analysis" Altgelt, K. H. and Gouw, T. H., Eds., pages 417 to 421, Marcel Dekker Inc., New York and Basel, 1979.

Means for determining the amount of surfactant and the amount of metal salt of an aromatic carboxylic acid are known to those skilled in the art. EP-A-0 876 449 describes methods for determining the number of moles of a calcium salt of an organic acid, which disclosure is incorporated herein.

A skilled person can also calculate the amounts in the final lubricating oil composition from information concerning the amount of raw materials (e.g., organic acids) used to make the detergent(s) and from information concerning the amount of detergent(s) used in the final oil composition. Analytical methods (e.g., potentiometric titration and chromatography) can also be used to determine the amounts of surfactant and metal salt of an aromatic carboxylic acid.

It will be appreciated by a skilled person in the art that the methods to determine the amount of metal salts of organic acids (also known as surfactants), including the amount of metal salts of aromatic carboxylic acids, are at best approximations and that differing methods will not always give exactly the same result; they are, however, sufficiently precise to allow the practice of the present invention.

Co-additives (C)

A dispersant additive (C1) maintains oil-insoluble substances, resulting from oxidation during use, in suspension in the fluid, thus preventing sludge flocculation and precipitation or deposition on metal parts. So-called ashless dispersants are organic materials which form substantially no ash on combustion, in contrast to metal-containing (and thus ash-forming) detergents. Borated metal-free dispersants are also regarded herein as ashless dispersants. Suitable dispersants include, for example, derivatives of long chain hydrocarbyl-substituted carboxylic acids, in which the hydrocarbyl group has a number average molecular weight tends of less than 15,000, such as less than 5000; examples of such derivatives being derivatives of high molecular weight hydrocarbyl-substituted succinic acid. Such hydrocarbyl-substituted carboxylic acids may be reacted with, for example, a nitrogen-containing compound, advantageously a polyalkylene polyamine, or with an ester. Particularly preferred dispersants are the reaction products of polyalkylene amines with alkenyl succinic anhydrides. Examples of specifications disclosing dispersants of the last-mentioned type are U.S. Pat. Nos. 3,202,678, 3,154,560, 3,172,892, 3,024,195, 3,024,237, 3,219,666, 3,216,936 and BE-A-662 875.

An ashless succinimide or a derivative thereof, obtainable from a polyisobutenylsuccinic anhydride produced from polybutene and maleic anhydride by a thermal reaction method using neither chlorine nor a chlorine atom-containing compound, is a preferred dispersant.

Preferably, the lubricating oil composition comprises a dispersant additive.

Alternatively, or in addition, dispersancy may be provided by polymeric compounds capable of providing viscosity index improving properties and dispersancy, such compounds are known as a dispersant viscosity index improver additive or a multifunctional viscosity index improver (C1). Such polymers differ from conventional viscosity index improvers in that they provide performance properties, such as dispersancy and/or antioxidancy, in addition to viscosity index improvement.

Dispersant olefin copolymers and dispersant polymethacrylates are examples of dispersant viscosity index improver additives. Dispersant viscosity index improver additives are prepared by chemically attaching various functional moieties, for example amines, alcohols and amides, onto polymers, which polymers preferably tend to have a number average molecular weight of at least 15,000, such in the range from 20,000 to 600,000, as determined by gel permeation chromatography or light scattering methods. The polymers used may be those described below with respect to viscosity modifiers. Therefore, amine molecules may be incorporated to impart dispersancy and/or antioxidancy characteristics, whereas phenolic molecules may be incorporated to improve antioxidant properties. A specific example, therefore, is an inter-polymer of ethylene-propylene post grafted with an active monomer such as maleic anhydride and then derivatized with, for example, an alcohol or amine.

EP-A-24146 and EP-A-0 854 904 describe examples of dispersants and dispersant viscosity index improvers, which are accordingly incorporated herein.

In a preferred embodiment of appropriate aspects of the present invention, independently of the other embodiments, the lubricating oil composition comprises a dispersant viscosity index improver additive instead of or in addition to a dispersant additive.

An antioxidant additive (C2) reduces the tendency of mineral oils to deteriorate in service, evidence of such deterioration being, for example, the production of varnish-like deposits on metal surfaces and of sludge, and viscosity increase. Suitable antioxidant additives include sulfurized alkyl phenols and alkali or alkaline earth metal salts thereof; hindered phenols including alkylene bridged phenols; diphenylamines; phenyl-naphthylamines; and phosphosulfurized or sulfurized hydrocarbons. A preferred antioxidant is an alkylene bridged phenol, Other antioxidants which may be used in lubricating oil compositions include oil-soluble copper compounds. The copper may be blended into the oil as any suitable oil-soluble copper compound. By oil-soluble it is meant that the compound is oil-soluble under normal blending conditions in the oil or additive package. The copper may, for example, be in the form of a copper dihydrocarbyl thio- or dithiophosphate. Alternatively, the copper may be added as the copper salt of a synthetic or natural carboxylic acid, for example, a $C_8$ to $C_{18}$ fatty acid, an unsaturated acid, or a branched carboxylic acid. Also useful are oil-soluble copper dithiocarbamates, sulfonates, phenates, and acetylacetonates. Examples of particularly useful copper compounds are basic, neutral or acidic copper $Cu^I$ and/or $Cu^{II}$ salts derived from alkenyl succinic acids or anhydrides.

Copper antioxidants will generally be employed in an amount of from about 5 to 500 ppm by weight of the copper, in the final lubricating composition.

An antiwear additive (C3), as its name implies, reduces wear of metal parts. Zinc dihydrocarbyl dithiophosphates (ZDDPs) are very widely used as antiwear additives. Examples of ZDDPs for use in oil-based compositions are those of the formula $Zn[SP(S)(OR^1)(OR^2)]_2$ wherein $R^1$ and $R^2$ contain from 1 to 18, and preferably 2 to 12, carbon atoms.

Particularly preferred is a ZDDP which has more secondary alkyl groups than primary alkyl groups, for example a ZDDP which has at least 50, preferably at least 75, advantageously 85–100, such as 100, mass % of secondary alkyl groups, based on the mass of the total alkyl groups.

Sulfur-containing and molybdenum-containing compounds are also examples of anti-wear additives. Also suitable are ashless phosphorus-containing and sulfur-containing compounds.

A preferred type of molybdenum compound is a trinuclear molybdenum compound, which advantageously has a sulfur-containing core. The compound may provide at least 1, for example 1 to 2000, such as 5 to 1000, preferably 20 to 1000, such as 30 to 500, especially 75 to 200, advantageously 50 to 150, ppm by mass of the Mo, expressed as Mo atoms, based on the mass of the composition.

In an embodiment, the trinuclear molybdenum compound has a core, preferably a sulfur-containing core, and bonded thereto one or more monoanionic ligands capable of rendering the compound oil-soluble or oil-dispersible, wherein the ratio of the number of molybdenum atoms in the core to the number of said ligands is greater than 1:1, such as 3:2 or greater.

In another embodiment, the trinuclear molybdenum compound is represented by the formula $MO_3S_kL_nQ_Z$ and mixtures thereof wherein the L are independently selected ligands having organo groups with a sufficient number of carbon atoms to render the compound soluble in the oil, n is from 1 to 4, k varies from 4 to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

Importantly, the organo groups of the ligands have a sufficient number of carbon atoms to render the compound soluble in the oil. For example, the number of carbon atoms in each group will generally range between 1 to 100, preferably from 1 to 30, and more preferably between 4 to 20. Preferred ligands include dialkyldithiophosphate, alkylxanthate, carboxylates, dialkyldithiocarbamate ("dtc"), and mixtures thereof. Most preferred are the dialkyldithiocarbamates. Those skilled in the art will realize that formation of the compounds of the present invention requires selection of ligands having the appropriate charge to balance the core's charge.

In an aspect of the present invention, a lubricating oil composition according to the fourth aspect further comprises (C4) a trinuclear molybdenum compound, in a minor amount, but wherein (C1) is a dispersant additive and/or a dispersant viscosity index improver additive.

Further, in a preferred embodiment of appropriate aspects of the present invention, independently of the other embodiments, the lubricating oil composition further comprises (C4) a trinuclear molybdenum compound, in a minor amount.

WO 98/26030 and U.S. Pat. No. 6,232,276 describe trinuclear molybdenum compounds and are, therefore, incorporated herein with respect to their disclosure relating to structures and compositions of trinuclear molybdenum compounds.

Viscosity index improvers (or viscosity modifiers) impart high and low temperature operability to a lubricating oil and permit it to remain shear stable at elevated temperatures and also exhibit acceptable viscosity or fluidity at low temperatures. Therefore, viscosity index improvers are useful in multigrade lubricant oil compositions. Suitable compounds for use as viscosity modifiers are generally high molecular weight hydrocarbon polymers, including polyesters, such as polymethacrylates; poly(ethylene-co-propylene) polymers and closely related modifications (so called olefin copolymers); hydrogenated poly(styrene-co-butadiene or -isoprene) polymers and modifications; and esterified poly (styrene-co-maleic anhydride) polymers. Oil-soluble viscosity modifying polymers generally have number average molecular weights of at least 15,000 to 1,000,000, preferably 20,000 to 600,000, as determined by gel permeation chromatography or light scattering methods. The disclosure in Chapter 5 of "Chemistry & Technology of Lubricants", edited by R. M. Mortier and S. T. Orzulik, First edition, 1992, Blackie Academic & Professional, is incorporated herein.

Other co-additives suitable in the present invention include corrosion inhibitors, friction modifiers, rust inhibitors or rust prevention agents, pour point depressants, demulsifiers, and anti-foaming agents.

Some of the above-mentioned additives may provide a multiplicity of effects; thus for example, a single additive may act as a dispersant-oxidation inhibitor. This approach is well known and need not be further elaborated herein.

When lubricating compositions contain one or more of the above-mentioned additives, including the detergents, each additive is typically blended into the base oil in an amount which enables the additive to provide its desired function. Representative effective amounts of such additives, when used in lubricants, are as follows:

| Additive | Mass % a.i.* (Broad) | Mass % a.i.* (Preferred) |
|---|---|---|
| Viscosity Index Improver | 0.01–6 | 0.01–4 |
| Corrosion Inhibitor | 0.01–5 | 0.01–1.5 |
| Antioxidant additive | 0.01–5 | 0.01–3 |
| Friction Modifier | 0.01–5 | 0.01–1.5 |
| Dispersant additive | 0.1–20 | 0.1–8 |
| Dispersant Viscosity Index Improver additive | 0.01–5 | 0.05–5 |
| Detergent composition | 0.01–10 | 0.01–6 |
| Antiwear additive | 0.01–6 | 0.01–4 |
| Pour Point Depressant | 0.01–5 | 0.01–1.5 |
| Rust Inhibitor | 0.001–0.5 | 0.01–0.2 |
| Anti–Foaming Agent | 0.001–0.3 | 0.001–0.15 |
| Demulsifier | 0.001–0.5 | 0.01–0.2 |

*Mass % active ingredient based on the final lubricating oil composition.

The additives may be incorporated into a base oil in any convenient way. Thus, each of the additive can be added directly to the oil by dispersing or dissolving it in the oil at the desired level of concentration. Such blending may occur at ambient temperature or at an elevated temperature.

When a plurality of additives are employed it may be desirable, although not essential, to prepare one or more additive packages (also known as additive compositions or concentrates) comprising the additives, whereby several additives, with the exception of viscosity modifiers, multifuntional viscosity modifiers and pour point depressants, can be added simultaneously to the base oil to form the lubricating oil composition. Dissolution of the additive package (s) into the lubricating oil may be facilitated by solvents and by mixing accompanied with mild heating, but this is not essential.

The additive package(s) will typically be formulated to contain the additive(s) in proper amounts to provide the desired concentration in the final formulation when the additive package(s) is/are combined with a predetermined amount of base lubricant. Thus, one or more detergents may be added to small amounts of a carrier fluid or diluent, such as a base oil or another compatible solvent together with other desirable additives to form additive packages containing active ingredients in an amount, based on the mass of the additive package, of, for example, from about 2.5 to about 90, preferably from about 5 to about 75, most preferably from about 8 to about 60, mass %, of additives in the appropriate proportions with the remainder being carrier fluid or diluent.

In a preferred embodiment of the seventh aspect, the amount of phosphorus is less than 0.5, more preferably less than 0.3, mass %, of phosphorus, based on the mass of the additive composition. In a preferred embodiment, the amount of phosphorus is at least 0.01 mass %, based on the mass of the additive composition.

Preferably, the additive composition of the seventh aspect has an amount of sulfur, independently of the amount of phosphorus, of less than 2.0, more preferably less than 2.00 or less than 1.75, mass %, based on the mass of the additive composition. In a preferred embodiment, the amount of sulfur is at least 0.01 mass %, based on the mass of the additive composition.

The amount of additives in the final lubricating oil composition is generally dependent on the type of the oil composition, for example, a heavy duty diesel engine lubricating oil composition has 2 to 20, preferably 7 to 18, more preferably 8 to 16, such as 8 to 14, mass % of additives based on the mass of the oil composition. A passenger car engine lubricating oil composition, for example, a gasoline or a diesel engine oil composition, may have a lower amount of additives, for example 3 to 10, preferably 4 to 9, especially 6 to 8, mass % of additives based on the mass of the oil composition.

Accordingly, it is preferred that the proportions of the (a) to (e) in an additive composition of the seventh aspect are such so to provide a lubricating oil composition, as defined in any one of the third to sixth aspect, when the oil composition contains 2 to 20 mass % of all of (a) to (e).

The method of preparing the oil composition according to the ninth aspect can involve admixing component (A) and an additive package that comprises components (B) and (C).

In a further embodiment of the seventh aspect, the proportions of the (a) to (e) in an additive composition of the seventh aspect are such so to provide a composition having less than 0.09 mass % of phosphorus and at most 0.5 mass % of sulfur, when the additive composition is diluted in a way that the diluted additive composition contains 3.75 mass % of components (b) to (d), based on the mass of the diluted composition. Preferably, the proportions of (a) to (e) are such as to also provide a composition having less than 2 mass % of sulfated ash.

Preferably the additive compositions of the present invention give a sulfated ash level of at most 10, more preferably at most 8, advantageously at most 7, mass %.

Preferably, the amount of anti-oxidant additives in the additive composition is in the range of from 1 to 20 parts, the amount of phosphorus-containing and/or sulfur-containing additives in the additive composition is in the range of from 1 to 9 parts.

It should be appreciated that interaction may take place between any two or more of the additives, including any two or more detergents, after they have been incorporated into the oil composition. The interaction may take place in either the process of mixing or any subsequent condition to which the composition is exposed, including the use of the composition in its working environment. Interactions may also take place when further auxiliary additives are added to the compositions of the invention or with components of oil. Such interaction may include interaction which alters the chemical constitution of the additives. Thus for example the compositions of the invention include compositions in which interaction, for example, between any of the additives, has occurred, as well as compositions in which no interaction has occurred, for example, between the components mixed in the oil.

In this specification:

The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group.

The term "comprising" or "comprises" when used herein is taken to specify the presence of stated features, integers, steps or components, but does not preclude the presence or addition of one or more other features, integers, steps, components or groups thereof. In the instance the term "comprising" or "comprises" is used herein, the terms "consisting essentially of" and "consisting of" and their cognates are within its scope and are preferred embodiments of it.

The term "oil-soluble" or "oil-dispersible", as used herein, does not mean that the additives are soluble, dissolvable, miscible or capable of being suspended in the oil in all proportions. They do mean, however, that the additives are, for instance, soluble or stable dispersible in the oil to an extent sufficient to exert their intended effect in the environment in which the oil composition is employed. Moreover, the additional incorporation of other additives such as those described above may affect the solubility or dispersibility of the additives.

"Major amount" means in excess of 50 mass % of the composition. "Minor amount" means less than 50 mass % of the composition, both in respect of the stated additive and in respect of the total mass % of all of the additives present in the composition, reckoned as active ingredient of the additive or additives.

All percentages reported are mass % on an active ingredient basis, i.e., without regard to carrier or diluent oil, unless otherwise stated.

The abbreviation SAE stands for Society of Automotive Engineers, who classify lubricants by viscosity grades.

The amount of phosphorus, sulfur and molybdenum in the lubricating oil composition is measured according to ASTM D5185; the amount of nitrogen in the lubricating oil composition is measured according to ASTM D4629; and the amount of chlorine in the lubricating oil composition is measured according to Institute of Petroleum Proposed Method AK/99.

The invention is illustrated by, but in no way limited to, the following examples.

EXAMPLES

Lubricating oil compositions respectively containing 0.07, 0.04 and 0, mass % of phosphorus, were prepared by blending methods known in the art. The oil compositions contained a detergent composition, a dispersant additive, an anti-oxidant additive, and an anti-wear additive (e.g., a zinc dithiophosphate) in varying amounts, including none in one case, to provide the different phosphorus levels. Each oil composition was a SAE 5W30 lubricating oil composition.

Comparative Examples 1 to 3 contained, as detergents, a phenate detergent and a sulfonate detergent only (in a surfactant ratio of about 73:27), and, as antioxidant, a phenolic antioxidant only. In contrast, Examples 1 to 3 of the invention contained, as detergents, a salicylate detergent only and, as antioxidant, an aminic antioxidant only. Table 1 shows the properties of the compositions.

The film thickness and wear performance of the compositions were measured on an elastohydrodynamic film thickness rig, a traction rig adapted to the pin on disc option, and in a four ball extreme pressure test.

Briefly, the elastohydrodynamic rig measures film thickness between a steel ball and a coated glass disc that are in rolling contact. The test conditions are a varying rolling speed; a temperature of 100° C.; 100% rolling contact (0% slide/roll ratio) and a load of 20 N. Full details of the apparatus and test procedure are described in Tribology International, 33 (2000), 241–247; SAE 962037; SAE 961142; and SAE 962640.

Oil compositions that exhibit larger film thickness are more likely to provide better wear performance; this is because thicker films are more likely to a) separate contacting surfaces and b) shear at lower stress than the underlying metal, thereby mitigating adhesive wear.

For the pin on disc option, the traction rig is as described in SAE 962037, SAE 961142, and SAE 962640, but where the steel ball is replaced by a steel pin of 0.5 mm diameter which contacts the steel disc at a constant load and temperature as described in SAE 981406. The disc is driven at a constant speed and the wear is measured by a linear voltage displacement transducer. The test conditions are: a time of 1 hour; a temperature of 100° C., a load of 30 N; and a sliding speed of 1 m/s.

The apparatus used in the four ball extreme pressure test is that used in the industry test IP239. The conditions are specified in the Peugeot D55-1136 method, and briefly these are: a rotating speed of 1500 rpm; a time of 60 seconds; and a load of either 100 kg or 85 kg.

Both the pin on disc option and four ball extreme pressure test measure wear under high pressure sliding contact conditions. Therefore, oil compositions that exhibit less wear in these tests are more likely to provide better wear performance.

Table 2 shows that the films formed in the test on Examples 1 to 3 (salicylate-containing oil compositions) are thicker than those formed in the corresponding Comparative Examples 1 to 3. The salicylate-containing oil compositions (Examples 2 and 3) show a surprising and significant advantage at lower phosphorus levels. In particular the salicylate-containing oil compositions substantially maintain the film thickness as the phosphorus level is reduced. This effect is demonstrated in the elastohydrodynamic rig at three different rolling speeds at least.

Similarly, the data from the traction rig adapted to the pin on disc option in Table 3 support the superior and unexpected performance of salicylate-containing oil compositions at low phosphorus levels: the salicylate-containing oil compositions exhibit less wear in compositions containing 0.04 mass % or less of phosphorus.

The data from the four ball extreme pressure test contained in Table 4 also confirm that salicylate-containing oil compositions provide improved wear performance, in particular in oils containing no phosphorus at two different loads (100 and 85 kg) at least.

TABLE 1

| Properties of oil compositions | Comparative Examples | | | Examples of Invention | | |
|---|---|---|---|---|---|---|
| | Comp. 1 | Comp. 2 | Comp. 3 | 1 | 2 | 3 |
| mass %[1] P, ASTM D5185 | 0.07 | 0.04 | 0.00 | 0.07 | 0.04 | 0.00 |
| mass %[1] S, ASTM D5185 | 0.55 | 0.45 | 0.35 | 0.20 | 0.15 | 0.10 |
| mass %[1] N (calculated) | 0.088 | 0.088 | 0.088 | 0.102 | 0.102 | 0.102 |
| Antioxidant content, mass %[1] | 0.35 | 0.35 | 0.35 | 0.21 | 0.21 | 0.21 |
| Surfactant content, mmol/kg[2] | 13.39 | 13.39 | 13.39 | 9.02 | 9.02 | 9.02 |
| TBN | 9.8 | 9.8 | 9.7 | 9.9 | 9.9 | 9.8 |
| Ash, % | 1.06 | 1.00 | 0.93 | 0.99 | 0.94 | 0.86 |
| HTHS, Ravensfield CEC L-36-A-90 | 3.60 | 3.58 | 3.52 | 3.48 | 3.45 | 3.42 |
| KV @ 100° C., ASTM D445 | 11.61 | 11.61 | 11.50 | 12.21 | 12.17 | 12.02 |
| CCS @ −25° C., ASTM D5293 | 2949 | 2901 | 2812 | 2971 | 2939 | 2806 |

[1]The mass percentage is based on the mass of the oil composition;
[2]mmol/kg is millimoles of surfactant per kilogram of the oil composition.

TABLE 2

| Film thickness, in nanometres, from the Elastohydrodynamic Rig | P content, mass % | Comp. Examples 1 to 3 | Examples of invention 1 to 3 |
|---|---|---|---|
| Rolling speed of 0.107 m/s | 0.07 | 12.7 | 16.9 |
| | 0.04 | 14.0 | 17.4 |
| | 0 | 10.0 | 15.4 |
| Rolling speed of 0.29 m/s | 0.07 | 22.5 | 30.4 |
| | 0.04 | 24.3 | 31.4 |
| | 0 | 18.6 | 27.6 |
| Rolling speed of 0.57 m/s | 0.07 | 33.2 | 44.5 |
| | 0.04 | 36.2 | 45.3 |
| | 0 | 30.8 | 42.0 |

TABLE 3

| Wear, in nanometres, from the Traction rig adapted to the pin on disc option | P content, mass % | Comp. Examples 1 to 3 | Examples of invention 1 to 3 |
|---|---|---|---|
| Wear after 3600 seconds | 0.07 | 40.8 | 44.1 |
| | 0.04 | 150.7 | 81.7 |
| | 0 | 302.9 | 230.8 |

TABLE 4

| Average wear scar, in millimetres, from the Four Ball Extreme Pressure Test | P content, mass % | Comp. Examples 1 to 3 | Examples of invention 1 to 3 |
|---|---|---|---|
| Average wear scar at 100 kg load | 0.07 | 2.05 | 1.87 |
| | 0.04 | 2.18 | 2.14 |
| | 0 | ∞* | 2.23 |

TABLE 4-continued

| Average wear scar, in millimetres, from the Four Ball Extreme Pressure Test | P content, mass % | Comp. Examples 1 to 3 | Examples of invention 1 to 3 |
|---|---|---|---|
| Average wear scar at 85 kg load | 0.07 | 1.87 | 0.45 |
| | 0.04 | 2.06 | 2.04 |
| | 0 | ∞* | 2.29 |

*the balls welded together, thereby giving an infinite wear scar

What is claimed is:

1. An SAE 5WX or SAE 0WX lubricating oil composition comprising:

(A) an oil of lubricating viscosity, in a major amount, and added thereto:

(B) a minor amount of detergent consisting essential of one or more metal salt of an aromatic carboxylic acid, and (C) co-additives comprising (C1) a dispersant additive and/or a dispersant viscosity index improver additive, (C2) an antioxidant additive and (C3) an antiwear additive, in respective minor amounts;

wherein the amount of phosphorus derived from (B) or (C) or both (B) and (C) is less than 0.09 mass %; and the amount of sulfur derived from (B) or (C) or both (B) and (C) is at most 0.5 mass %; each based on the mass of the oil composition; and X represents any one of 20, 30, 40 and 50.

2. The oil composition claimed in claim 1, wherein the oil of lubricating viscosity comprises a synthetic basestock.

3. The oil composition claimed in claim 1, wherein the lubricating oil composition is in the form of a heavy duty diesel engine lubricating oil composition.

4. The oil composition claimed in claim 1, wherein the lubricating oil composition is in the form of a passenger car engine lubricating oil composition.

* * * * *

UNITED STATES PATENT AND TRADEMARK OFFICE

CERTIFICATE OF CORRECTION

PATENT NO. : 6,784,143 B2
DATED : August 31, 2004
INVENTOR(S) : Locke et al.

It is certified that error appears in the above-identified patent and that said Letters Patent is hereby corrected as shown below:

Column 20,
Line 38, delete “essential” and insert -- essentially --.

Signed and Sealed this

Twenty-first Day of December, 2004

JON W. DUDAS
*Director of the United States Patent and Trademark Office*